United States Patent [19]

Landreth

[11] 4,186,160

[45] Jan. 29, 1980

[54] METHOD AND APPARATUS FOR FORMING BUILDING FOUNDATIONS

[76] Inventor: George H. Landreth, 180 E. Jersey St., Gladstone, Oreg. 97027

[21] Appl. No.: 962,093

[22] Filed: Nov. 20, 1978

Related U.S. Application Data

[62] Division of Ser. No. 760,753, Jan. 19, 1977.

[51] Int. Cl.[2] ..... E04B 1/54

[52] U.S. Cl. ..... 264/34; 52/293; 249/34; 264/293

[58] Field of Search ..... 264/34, 293; 249/34; 52/293

[56] References Cited

U.S. PATENT DOCUMENTS

| | | | |
|---|---|---|---|
| 2,091,552 | 8/1937 | MaCauley | 52/293 |
| 2,099,077 | 11/1937 | Pessagno | 249/34 |
| 2,332,166 | 10/1943 | Reiner | 249/34 X |
| 2,490,228 | 12/1949 | Pontierre | 249/34 X |
| 2,722,040 | 11/1955 | Ludowici | 52/293 X |
| 2,899,735 | 8/1959 | Graef | 249/34 |
| 2,973,567 | 3/1961 | Brow | 249/34 |
| 3,722,849 | 3/1973 | Luyben | 249/34 |
| 3,778,020 | 12/1973 | Burrows | 249/34 X |

*Primary Examiner*—Thomas P. Pavelko
*Attorney, Agent, or Firm*—A. William King

[57] ABSTRACT

A method for forming three parallel elongate grooves of predetermined size and spacing in a hardenable building material during a plastic state thereof, for forming a perimeter-type building foundation.

1 Claim, 10 Drawing Figures

METHOD AND APPARATUS FOR FORMING BUILDING FOUNDATIONS

REFERENCE TO RELATED APPLICATIONS

This is a division of my U.S. Application Ser. No. 760,753, filed Jan. 19, 1977, and entitled METHOD AND APPARATUS FOR FORMING BUILDING FOUNDATIONS.

BACKGROUND OF THE INVENTION

The present invention is applicable to the formation of a perimeter-type building foundation comprising a footing and wall atop said footing, both constructed from a hardenable plastic material, and is especially applicable to the formation of such foundations using wood forms and a concrete mixture. The present invention is also useful in forming such foundations using any hardenable plastic material having strength characteristics suitable for a building foundation.

The art of forming perimeter-type building foundations using a plastic concrete mixture is well known and is generally accomplished in a multi-step process. A first form comprising elongate vertical walls is constructed using elongate members such as sheets of plywood to define a space therebetween that has the general shape of an elongate footing of predetermined length. The first form is inserted and supported in a trench prepared in the earth and thereafter a predetermined amount of plastic concrete material is prepared and poured into the first form so as to form a footing therein.

Once the footing has hardened, a second form also comprising vertical walls is constructed on the top surface of the footing to define an elongate space between the vertical walls thereof that has the general shape of an elongate wall of predetermined length and height. A second predetermined amount of plastic concrete material is prepared and poured into the second form so as to form a wall therein. The process is completed by removing the first and second forms from the hardened perimeter-type foundation.

Current building codes generally mandate that the wall formed by this process include a longitudinal portion projecting from the bottom thereof and intruding into the footing so as to anchor the wall therein. Such codes generally require that this integral projection or "key" have both a width dimension and a depth dimension of at least 1.5 inches in order to insure that a standard 6-inch wall is adequately anchored in its footing.

In the current state of the art, the initial step in forming the key is to move an elongate member such as a piece of 2×4 lumber into the top surface of an elongate footing during the plastic state thereof so as to form a central, longitudinal keyway having the prerequisite 1.5 inch×1.5 inch configuration. Once the footing is hardened, the second form is mounted atop the footing with its interior exposed to the keyway and thereafter a second predetermined amount of the plastic concrete material is poured into the space defined by the second form with a portion thereof flowing into the elongate keyway which will thereafter harden to form a key to solidly anchor the wall in its footing.

A major drawback in the formation of concrete perimeter-type building foundations is the lack of an efficient form apparatus and method for securing the second form atop the hardened footing until the wall has been poured and allowed to harden. Although several form mounting methods are being used, the more prevalent procedure is to anchor the second form upon the hardened footing using form-ties and top-ties.

Form-ties are elongate metal members extending transversely across the top of the footing and having a pair of upturned flanges extending from each end. A predetermined spacing is provided between each pair of upturned flanges so as to permit the reception of the lower edges of a pair of spaced, opposed plywood sheets or the like comprising the sidewalls of the second form.

Top-ties are transversely extending elongate metal members having a pair of downturned flanges extending from each end. Each downturned flange is adapted to be fastened to the top outer edge of one of the sidewalls of the second form, and is spaced from the opposing downturned flange by a predetermined distance so as to separate the form sidewalls according to a predetermined wall-width.

In use, a sufficient quantity of form-ties are placed transversely atop the solid footing so that their respective upturned flanges form longitudinal parallel lines relative to the elongate footing. The sidewalls of the second form are inserted into and receive lateral anchoring support from the spaced upturned flanges of the form-ties. Erection of the second form is completed by attaching a plurality of top-ties transversely to the top edges of each of the sidewalls.

Several difficulties attend this method for anchoring the second form atop the solid footing. First, a large number of form-ties are required to anchor a standard peripheral-type building foundation, requiring a sizable initial investment to obtain a sufficient quantity of form-ties. More importantly, the hardened wall captures the mid-portion of each form-tie and, hence, unlike the top-ties which are thereafter removed for additional applications, the form-ties are integral to the foundation and cannot be removed. Accordingly, the investment in form-ties is a continuing one.

Moreover, the foregoing process involves an inordinate amount of labor in accurately positioning the form-ties so as to insure the trueness and desired positioning of the walls. Since the form-ties are not fastened to the top surface of the footing until captured by the poured wall, the application of any lateral force thereto causes the form-ties to move and necessitates extensive realignment of the form-ties during the insertion of the sidewalls.

What is needed therefore, and what the present invention provides, is a method for obtaining lateral anchoring support for a wall form atop a solid concrete footing which eliminates inordinate investments in form-ties, simplifies the insertion process thereby lowering labor costs, and insures that the elongate key will be centered along the longitudinal centerline of the elongate wall.

SUMMARY OF THE INVENTION

The present invention relates generally to improvements in the formation of a perimeter-type building foundation comprising a footing and wall atop said footing, and is particularly directed to a more efficient method for providing lateral anchoring support for a wall form atop a hardened footing.

A tool is used to form three parallel elongate grooves longitudinally along the top surface of an elongate footing during a plastic state thereof. In the preferred embodiment the tool has a pair of elongate groove-forming members mounted on the bottom surface of a support member so as to be oriented in mutual parallelism and spaced transversely apart by a predetermined distance corresponding to the desired interior spacing between the sidewalls of the wall form. The tool further has an elongate keyway groove-forming member mounted on the bottom surface of the supporting member between the pair of groove-forming members and oriented so as to be parallel to and spaced equidistantly therefrom.

A process is disclosed for forming perimeter-type building foundations comprising a footing and wall atop said footing. The process uses the combination keyway and grooving tool of the present invention to form parallel elongate wall form supporting grooves in the foundation footing during a plastic state thereof. The supporting grooves formed by the tool have a predetermined configuration so as to permit the introduction of the bottom edges of the sidewalls of a wall form into the supporting grooves after hardening of the footing to thereby provide lateral anchoring support for the sidewalls without the need for form-ties. Also, the keyway formed by the tool between the two supporting grooves has a predetermined configuration so as to permit the formation of the requisite keyway therein.

It is therefore a primary objective of the present invention to simplify the installation of an elongate wall form upon a hardened elongate perimeter-type footing and thereby reduce the amount of labor and cost thereof incurred in installing the wall form upon the footing.

A further objective is to solidly anchor the wall form atop the hardened footing so as to insure that the form will be oriented in a predetermined immovable position relative to the footing during the erection of the form and thereby insure that the orientation will not be dislocated during the erection process.

A still further objective is to position the wall form atop a hardened footing so as to insure that the interior of the form is exposed to and automatically centered on a keyway formed in the footing.

A further objective is to solidly anchor the wall form atop the hardened footing without need for lateral support members such as form-ties at the bottom edges of the form sidewalls and thereby eliminate repetitive investments in such lateral support members.

DETAILED DESCRIPTION OF THE INVENTION

Figure 1:
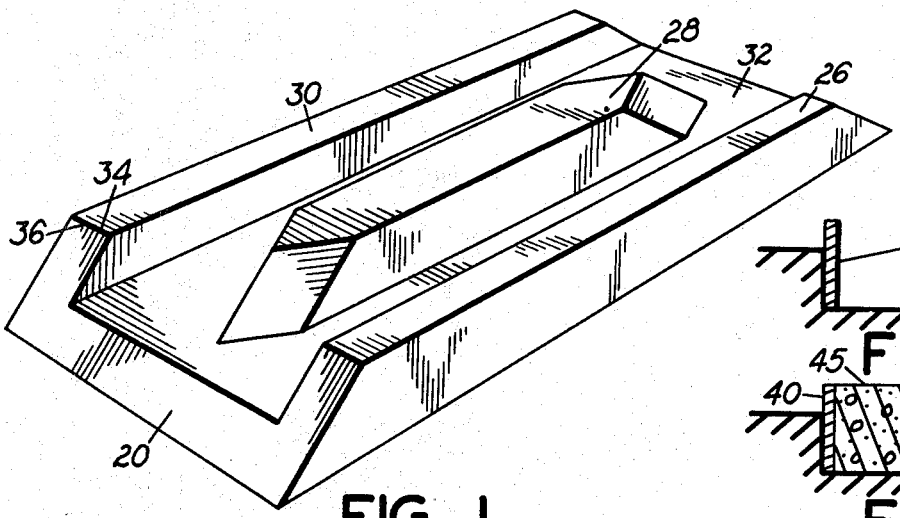
FIG. 1 is a perspective view of an inverted exemplary embodiment of the combination keyway and grooving tool of the present invention.

With particular reference to FIGS. 1–4, a preferred embodiment of the tool of the present method is set forth wherein 20 is an elongate supporting member. A handle 22 is mounted on a top surface 24 of the supporting member 20 for manipulating the supporting member along a top surface of an elongate foundation footing. A pair of elongate groove-forming members 26 and 30, and a central key-forming member 28, are mounted on a bottom surface 32 of the supporting member 20 and are used for forming parallel, transversely spaced elongate grooves in the top of a freshly poured foundation footing as described hereafter.

The pair of groove-forming members 26 and 30 are oriented in mutual parallelism adjacent the longitudinal edges of the supporting member 20, and extend downwardly from the bottom surface 32 by a first predetermined distance and are spaced transversely apart by a second predetermined distance. The keyway forming member 28 is oriented parallel to and spaced equidistantly between the groove forming members 26 and 30 and extends downwardly from the bottom surface 32 by a third predetermined distance, greater than the said first predetermined distance.

Figure 2:
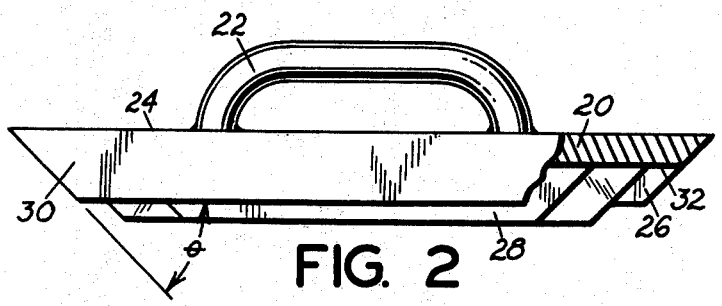
FIG. 2 is a side view of the combination keyway and grooving tool of FIG. 1.

The ends of the groove-forming members 26 and 30 and of the supporting member 20 are beveled at mutually downwardly converging predetermined angles as best seen in FIG. 2 so that the supporting member 20 protrudes forwardly and rearwardly from the ends of the groove-forming members 26 and 30. The fact that the tool is formed with bevels at both ends permits it to be manipulated with either end thereof acting as its leading edge and creates, in conjunction with the flat bottom surface 32 of the supporting member 20 a "hydroplaning" effect which prevents either the groove-forming members 26 and 30 or the supporting member 20 from submerging into a plastic material as it is moved thereon.

Figure 3:
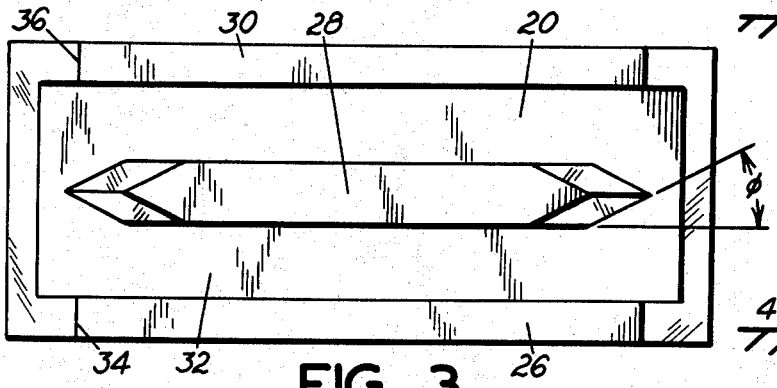
FIG. 3 is a bottom view of the combination keyway and grooving tool of FIG. 1.
Figure 4:
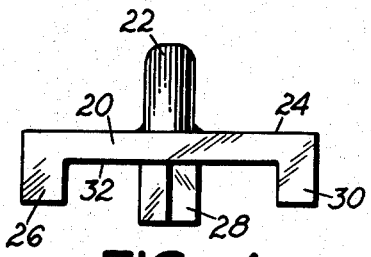
FIG. 4 is a end view of the combination keyway and grooving tool of FIG. 1.

The ends of the keyway forming member 28 are beveled and prow-shaped, forming downwardly converging angles as shown in FIG. 2 and longitudinally tapered surfaces as shown in FIG. 3. The fact that the keyway forming member 28 is prow-shaped at both ends compensates for its larger cross-section relative to the groove-forming members 26 and 30 and permits the manipulating handle 22 to move the members 26, 28 and 30 readily through a plastic material with either end acting as the leading edge of the tool.

Each of the groove-forming members 26 and 30 has a cross-section preferably having width and depth dimensions of about 1 inch respectively. The function of each support groove formed by these members in the surface of a freshly poured footing is to receive a bottom edge of a respective sidewall panel of a wall form and to provide bottom lateral support thereto. Head pressures of the plastic material to be used in a wall form for a standard 6-inch wall demand that plywood sidewalls have a thickness of $\frac{3}{4}$ inch in order to provide containment thereof and thereby insure the perpendicularity of the resultant wall. A one-inch groove width permits easy insertion of a $\frac{3}{4}$ inch thick sidewall panel. However, shorter 6-inch walls permit plywood thickness to be decreased to approximately $\frac{5}{8}$ inch, and in such case a groove having a width of at least $\frac{3}{4}$ inch would be sufficient. Larger walls, such as 8-inch walls, might require correspondingly thicker sidewalls and wider grooves.

The keyway forming member 28 has a cross-section having width and depth dimensions which must be substantially at least 1.5 inches respectively so as to permit the formation of a keyway that conforms to applicable building codes.

Although the preferred embodiment of the tool is cast using Magnesium, the tool can be fabricated using any lightweight, durable, substantially rigid material.

Figure 5:
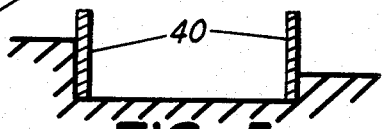
FIGS. 5 through 10 are cross-sectional views showing the sequential steps involved in forming a perimeter foundation according to the present invention.
Figure 6:
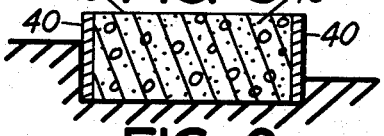

The use of the combination grooving and keyway tool of the present invention is best understood with reference to FIGS. 5–10. The formation of a perimeter-type footing 46 is well known in the art and is illustrated in FIGS. 5–6 as including the steps of digging an elongate trench in the ground having a predetermined configuration so as to receive and support therein a predetermined footing form, installing the sidewalls 40 of the footing form in the trench, preparing a first amount of concrete mixture and pouring and leveling the mixture in the space defined by the footing form so as to form therein a predetermined footing 46 of a size sufficient to support a wall atop the footing plus any structure thereafter supported by the wall.

Figure 7:
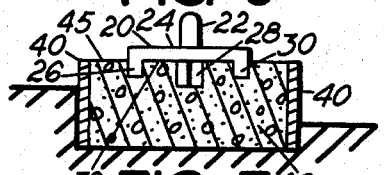

Before the footing 46 reaches a hardened state, the combination keyway and grooving tool is grasped by its handle 22 and placed on the footing 46 as shown in FIG. 7 so that the bottom surface 32 of the supporting member 20 rests upon the top surface 45 of the footing 46. The tool is then moved longitudinally along the top surface of the elongate footing so as to cause the groove-forming members 26 and 30 and the keyway-forming member 28 to form grooves 52, 54 and 56 respectively in the top surface of the foundation footing, as is best seen in FIG. 8.

Figure 8:
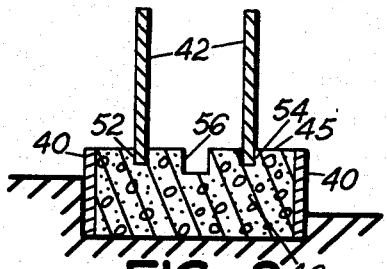
Figure 9:
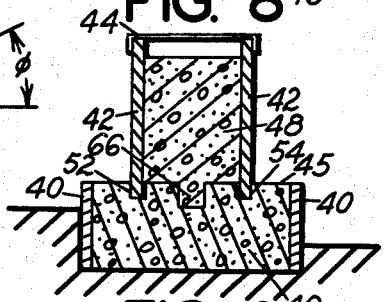

After the footing 46 hardens, the bottom edges of the sidewalls 42 of the wall form are mounted in the support grooves 52 and 54 as shown in FIGS. 8 and 9 and define therebetween a space generally in the shape of an elongate wall, such space being exposed to the keyway groove 56. Erection of the wall form is completed by attaching a plurality of top-ties 44 to the top edges of the sidewalls 42 at spaced intervals in the conventional manner.

The fact that the grooves 52 and 54 are formed in the footing so as to have a width dimension slightly greater than the thickness of the sidewalls 42 of the wall form, and the fact that the wall form is not installed until the footing has hardened, facilitates the installation process since the supporting structure for the wall form is rigid and readily receives therein the bottom edges of the wall form.

A second amount of concrete mixture is prepared and poured into the space defined by the sidewalls 42 of the wall form and that portion of the footing 46 which defines the keyway 56, so as to form a wall 48 and an integral key 66 as is best seen in FIG. 9.

Figure 10:
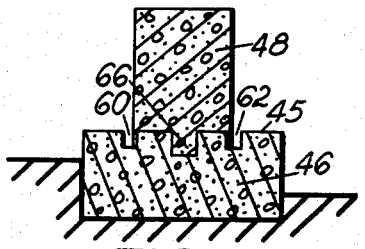

Thereafter, the top-ties 44, the wall form sidewalls 42 and the footing form sidewalls 40 can be removed from the hardened foundation for subsequent use in the formation of other foundations, thereby completing a finished building foundation, as is best seen in FIG. 10.

The fact that the bottom edges of the wall form sidewalls 42 are not mounted flush with the top surface 45 of the footing 46 results in a finished foundation footing having grooves 60 and 62 proximate the base of the wall 48. In the preferred embodiment, the grooves have a width dimension and a depth dimension that are slightly greater than $\frac{3}{4}''$ and therefore the external one of the grooves can readily receive a $\frac{3}{4}''$ elongate pipe or gravel to provide supplemental drainage for the foundation. Alternatively, an enlarged groove-forming member and a mating wall form sidewall having an outwardly protruding horizontal flange at its bottom edge can be used to produce an external groove having a sufficiently larger cross-section to receive still larger drainage pipes or amounts of gravel.

It is often necessary to pour a slab floor within the area defined by the perimeter foundation walls, such as preparatory to forming or completing a cellar or garage. In such cases the interior one of the grooves 60, 62 can be used to form an integral keyway between the slab floor and the footing. Alternatively, in some locations, leakage occurs at the boundary between a basement floor and the foundation walls. This leakage is eliminated by chipping a sealing groove along the foundation wall which is thereafter filled with a hot bitumious material. In these cases, the interior one of the grooves 60, 62 can be exploited to eliminate the need for chipping sealing grooves. Still other uses for the interior groove and the external groove formed by the above method will be apparent to those skilled in the art.

The terms and expressions which have been employed in the foregoing abstract and specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A process for forming a perimeter-type building foundation comprising a footing and wall atop said footing from a hardenable plastic material, said process comprising:

(a) mounting a first elongate form having the general shape of said footing upon a working surface;

(b) pouring a first predetermined amount of said plastic material into said first form so as to form said footing;

(c) forming a pair of parallel, elongate, transversely spaced grooves and an intermediate elongate keyway parallel to and equidistant from said pair of grooves longitudinally in a top surface of said footing while said plastic material is in said plastic state;

(d) thereafter allowing said plastic material to harden;

(e) thereafter mounting a second elongate form having the general shape of said wall and comprising a pair of opposed upright sidewalls upon said top surface of said footing so that the interior of said second form is exposed to said keyway and inserting a lower part of each of said sidewalls into a respective one of said pair of grooves so as to obtain lateral anchoring support from said grooves;

(f) pouring a second predetermined amount of said plastic material into said second form and into said keyway so as to form said wall and a key integral to said wall; and (g) allowing said second amount of plastic material to harden.

* * * * *